US005211581A

United States Patent [19]

Schwartz et al.

[11] Patent Number: 5,211,581

[45] Date of Patent: May 18, 1993

[54] ELECTRICAL CONNECTOR ASSEMBLY AND METHOD THEREFOR

[75] Inventors: Mark W. Schwartz, Addison; Paul J. Moller, Lake Zurich; Zdravko M. Zakman, Schaumburg, all of Ill.

[73] Assignee: Motorola, Inc., Schaumburg, Ill.

[21] Appl. No.: 922,301

[22] Filed: Jul. 30, 1992

[51] Int. Cl.[5] ..... H01R 9/07

[52] U.S. Cl. ..... 439/581; 439/218; 439/916; 343/900

[58] Field of Search ..... 439/620, 578–585, 439/63, 675, 916; 343/702, 900, 906

[56] References Cited

U.S. PATENT DOCUMENTS

| | | | |
|---|---|---|---|
| 4,368,940 | 1/1983 | Sugiura | 439/916 |
| 4,537,453 | 8/1985 | Takeuchi | 439/217 |
| 4,636,015 | 1/1987 | Ford, Jr. | 439/916 |
| 4,690,471 | 9/1987 | Marabotto et al. | 439/916 |
| 4,867,698 | 9/1989 | Griffiths | 439/916 |
| 5,015,194 | 5/1991 | Seas | 439/916 |

*Primary Examiner*—David L. Pirlot
*Attorney, Agent, or Firm*—Robert H. Kelly

[57] ABSTRACT

An assembly, and associated method for constructing such, for connecting an electrical circuit to an electrical cable, such as an antenna connector pin, or, alternately, to a coaxial transmission line. An antenna circuit board includes a circular aperture extending therethrough for receiving a socket member to be supported thereat. Angled, segmental-slots are formed about the circular aperture and receive projecting prong-members of a clip member. The socket member receives the electrical cable, such as the antenna connector pin, or a coaxial conductor pin therein. The clip member engages with a coaxial tube of the coaxial transmission line. The assembly permits alternate connection thereto of either the electrical cable or the coaxial transmission line thereat.

19 Claims, 4 Drawing Sheets

ELECTRICAL CONNECTOR ASSEMBLY AND METHOD THEREFOR

BACKGROUND OF THE INVENTION

The present invention relates generally to electrical connectors, and, more particularly, but without way of limitation, to an electrical connector assembly for connecting electrical circuitry of a radio transceiver alternately to an electrical cable or to a coaxial transmission line.

Advancements in the field of radio electronics have permitted the introduction and commercialization of an ever-increasing array of radio communication apparatus. Advancements in electronic circuitry design have also permitted increased miniaturization of the electronic circuitry comprising such radio communication apparatus. As a result, an ever-increasing array of radio communication apparatus comprised of ever-smaller electronic circuitry has permitted the radio communication apparatus to be utilized more conveniently in an increased number of applications.

A radio transceiver, such as a radiotelephone utilized in a cellular, communication system, is one example of radio communication apparatus which has been miniaturized to be utilized conveniently in an increased number of applications. A radio transceiver includes transmitter and receiver circuitry which permits both transmission and reception of radio frequency signals.

Additional efforts to miniaturize further the electronic circuitry of similar such radio transceivers, as well as other radio communication apparatus, are being made. Such further miniaturization of the radio transceivers will further increase the convenience of utilization of such apparatus, and will permit such apparatus to be utilized in further increased numbers of applications.

Pursuant to such efforts to miniaturize further the electronic circuitry of such radio transceivers (as well as other radio communication apparatus), size minimization of the electronic circuitry is a critical design goal during design of such circuitry.

Housing structures which house the electronic circuitry of such radio transceivers have been correspondingly reduced in size. Conventional, housing structures used to house such electronic circuitry are typically comprised of a front housing portion and a rear housing portion. And, in most instances, electronic circuitry is disposed upon a circuit board (or several circuit boards). Such circuit board shall hereinafter be referred to as the "primary" circuit board.

Electromagnetic shields are also oftentimes placed over, and beyond the sides of, the electronic circuitry disposed upon the circuit board. Such shields prevent the emanation of spurious, electromagnetic waves generated by the electronic circuitry during circuit operation. In a portable radiotelephone, such shields oftentimes include a metal plate forming a second circuit board. Such second circuit board, much smaller in dimensions than that of the primary circuit board, is positioned within the housing structure such that a first face surface thereof may be positioned in abutment against the edge surface of the primary circuit board. In some instances, a circuit path disposed upon the second circuit board may be formed to connect with a corresponding circuit path disposed upon the primary circuit board when the two circuit boards are in the abutting engagement.

The circuit board upon which the electronic circuitry is disposed, is mounted, or otherwise affixed, to one of the housing portions of the housing structure. Once the circuit board has been affixed in position, the housing portions are tandemly positioned in a manner to enclose thereby the circuit board in supportive engagement therewithin. Once the two housing portions are positioned in such tandem relationship, a fastening mechanism is utilized to fasten the front and rear housing portions theretogether.

Most conventional, radio transceivers, include an antenna for receiving signals transmitted to the receiver circuitry of the transceiver and also to transmit signals generated by the transmitter circuitry of the transceiver. Such antennas typically protrude beyond a top end of the housing. In some constructions of radio transceivers, all of part of the antenna may be retracted into the housing structure when the transceiver is not in use.

Typically, the circuit board is elongated in a lengthwise dimension, and the face surfaces of the circuit board face corresponding face surfaces of the housing portions of the housing structure. Only an end side surface of the circuit board faces the top end of the housing from which the antenna extends. Because the face surface of the circuit board does not face the top end of the housing, connection between the antenna and the circuitry disposed upon the circuit board can only be effected with some difficulty.

To facilitate connection of the antenna to the circuitry disposed upon the primary circuit board, the metal plate forming the second circuit board may be advantageously put to additional use. While the first face surface of the second circuit board abuts against the edge surface of the primary circuit board, a second face surface of the second circuit board is positioned to face the top end of the housing. Such second face surface may be utilized to facilitate connection of the antenna as a connector may be disposed upon the second circuit board to connect with the antenna. By electrically connecting the connector disposed upon the second circuit board to the primary circuit board, the antenna may thereby be connected to the circuitry disposed upon the primary circuit board.

As most of the circuitry of the transceiver is disposed upon the primary circuit board, such circuit board shall hereafter be referred to as the transceiver, or receiver, circuit board, and the second circuit board shall be referred to as the antenna circuit board.

A connector which connects the antenna to the antenna circuit board should be of a design permitting assembly thereof in an assembly line-like operation.

During, and after, assembly of the circuit components of the electronic circuitry of the radio transceiver (or radio receiver), the receiver circuitry of the transceiver (or of the receiver) is tested to ensure that the circuitry is functioning properly. Such tests typically involve the application of a known signal to the circuitry. A determination of proper functioning, or malfunctioning, of the receiver circuitry may then be made by analysis of the signal generated by the receiver circuitry in response to reception of such known signal.

Commercially-available signal generators are available for such testing, but such generators generate the signal upon a coaxial transmission line having a coaxial conductor pin surrounded by a coaxial tube. Such coaxial transmission lines and signal generators are together of a particular impedance, such as fifty ohms. It is further noted that, during troubleshooting and repair operations, such generators are also used.

Construction of the connector to permit use of the same connector which connects the antenna to the transceiver circuitry alternately to permit connection of the coaxial transmission line would aid in the minimization of the physical dimensions of the transceiver. (As noted above, minimization of the physical dimensions of the radio communication apparatus is an ongoing design goal.) Accordingly, the connector which connects the antenna pin of an antenna to the radio receiver circuitry should further permit alternate connection thereto of a coaxial transmission line.

What is needed, therefore, is a connector for connecting alternately, an antenna pin or a coaxial transmission line to an electrical circuit.

SUMMARY OF THE INVENTION

The present invention, accordingly, advantageously provides a connector for connecting an electrical circuit with an electrical cable, such as an antenna connector pin.

The present invention further advantageously provides a connector for connecting an electrical circuit with a coaxial transmission line.

The present invention yet further advantageously provides a connector for connecting, alternately, an antenna pin or a coaxial transmission line to an electrical circuit.

The present invention still further advantageously provides a method for connecting an electrical circuit to an electrical cable, or, alternately, to a coaxial transmission line.

The present invention includes further advantages and features, the details of which will become more apparent by reading the following, detailed description of the preferred embodiments hereinbelow.

In accordance with the present invention, therefore, an assembly, and associated method, for connecting an electrical circuit to an electrical cable, or, alternately, to a coaxial transmission line is disclosed. The assembly comprises a substrate having a first receiving port extending through the substrate, and a second receiving port, spaced-apart from the first receiving port also extending through the substrate. A socket member comprised of an electrically-conductive material is inserted through the first receiving port to be supported thereat. The socket member receives the electrical cable, or, alternately, a coaxial conductor pin of the coaxial transmission line therein, thereby to permit electrical connection of the electrical cable, or, alternately, of the coaxial conductor pin therewith. A clip member comprised of an electrically-conductive material is inserted through the second receiving port to be supported thereat. The clip member engages with a coaxial tube which surrounds the coaxial conductor pin of the coaxial transmission line, thereby to connect electrically the coaxial tube of the coaxial transmission line with the conductive line leading to the second receiving port.

BRIEF DESCRIPTION OF THE DRAWINGS

The present invention will be better understood when read in light of the accompanying drawings in which.

DESCRIPTION OF THE PREFERRED EMBODIMENTS

Figure 1:
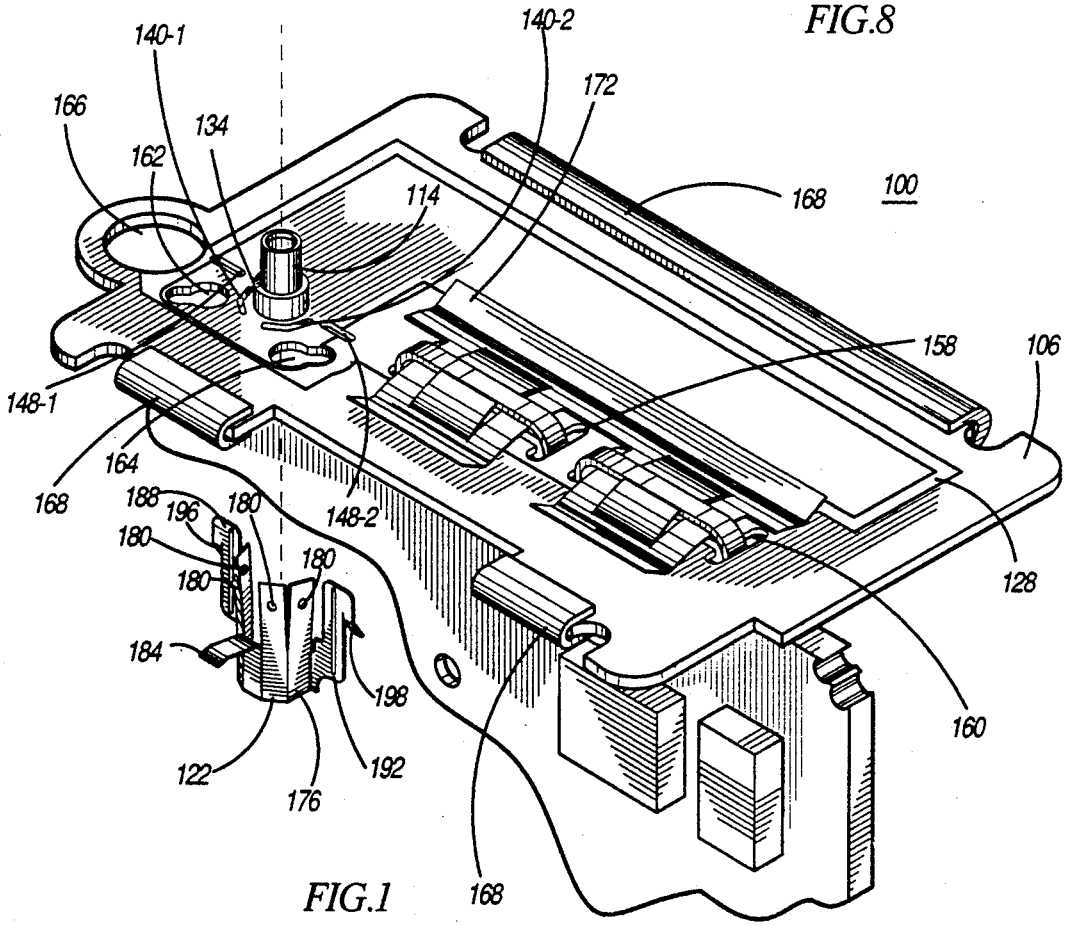
FIG. 1 is an exploded view of the assembly of a preferred embodiment of the present invention.

Referring first to the exploded view of FIG. 1, the assembly, referred to generally by reference numeral 100, of a preferred embodiment of the present invention is shown. Assembly 100 is comprised of a substrate, here antenna circuit board 106, socket member 114, and clip member 122. Socket member 114 and clip member 122 are both comprised of an electrically-conductive material.

It should be noted at the outset that, while the preferred embodiments of the figures illustrate an assembly having an antenna circuit board with a circuit path of an electrical circuit disposed thereupon, the assembly of the present invention may comprise other substrates.

Antenna circuit board 106 is generally rectangular in configuration and includes conductive path 128 formed upon a face surface thereof. A circular aperture forming first receiving port 134 extends through circuit board 106. A second receiving port comprised of first and second, angled segmental slots 140-1 and 140-2 are also formed to extend through circuit board 106 between opposing face surfaces thereof. First and second alignment ports 148-1 and 148-2 are further formed to extend through circuit board 106 between opposing face surfaces thereof.

The second receiving port comprised of angled, segmental-slots 140-1 and 140-2 are spaced apart from first receiving port 134. Segmental-slots 140-1 and 140-2 are positioned about circumferential portions of a circle centered at a center of the aperture forming first receiving port 134.

It is noted that circuit path 128 extends to segmental-slots 140-1 and 140-2 (and also to alignment ports 148-1 and 148-2) but does not extend to first receiving port 134.

Circuit board 106 further includes longitudinally extending slots 158 and 160, and antenna mating ports 162, 164 and 166. FIG. 1 further illustrates grounding elastomers 168 positioned about selected edge surfaces of the circuit board, and circuit board clip 172.

Socket member 114 is of dimensions permitting insertion thereof through first receiving port 134 and includes lipped portion 172 for seating of socket member 114 at first receiving port 134.

Clip member 122 is shown to be comprised of a semicircular body portion 176 beyond which a plurality of projecting prong-members 180 project. In the preferred embodiment illustrated in the figure, clip member 122 includes four projecting prong-members 180. Prong members-180 are of dimensions permitting insertion thereof through angled, segmental-slots 140-1 and 140-2 of the second receiving port formed to extend through circuit board 106.

In the preferred embodiment illustrated in the figure, two prong-members 180 formed to extend beyond a left-hand side of body portion 176 are formed to permit insertion thereof through first, angled segmental-slot 140-1, and two projecting prong-members 180 formed to project beyond a right-hand side portion of body portion 176 are positioned to permit insertion thereof through second, angled segmental-slot 140-2.

Angled shankpiece 184 is formed to project at a substantially perpendicular angle beyond body portion 176. Shankpiece 184 is operative to abut against a face surface of circuit board 106 (the face surface hidden from view in FIG. 1) when projecting prong-members 180 are inserted through the segmental-slots 140-1 and 140-2 forming the second receiving port.

Clip member 122 further includes fin members 188 and 192 extending beyond opposing side, edge portions of body portion 176. Fin members 188 and 192 are elongated in longitudinal directions and are of dimensions permitting insertion of portions of such fin members through alignment ports 148-1 and 148-2. Face surfaces of fin member 188 and 192 are further formed to extend in similar planar directions to be coplanar thereby. Longitudinal cuts are formed to extend along a portion of the length of fin members 188 and 192.

Once socket member 114 is inserted into first receiving port 134 to be supported thereat, and clip member 122 is positioned such that projecting prong-members 180 are inserted to extend through segmental-slots 140-1 and 140-2 of the second receiving port, assembly 100 forms a connector for connecting an antenna pin, or, alternately, a coaxial transmission line thereto.

Figure 2:
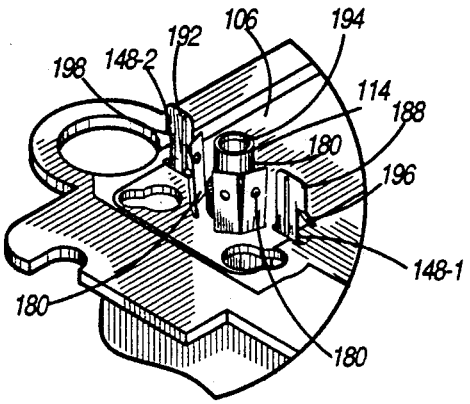
FIG. 2 is a cut-away, enlarged view of a portion of the assembly of FIG. 1 illustrating the relationship between the substrate, socket member, and clip member of the assembly of FIG. 1, once assembled theretogether.

Turning next to the enlarged, cutaway view of FIG. 2, the relationship between circuit board 106, socket member 114, and clip member 122 is shown. Projecting prong-members 180 of clip member 122 extend through angled, segmental-slots 140-1 and 140-2 and project beyond a face surface of circuit board 106. Prong-members 180 are spaced apart from socket member 114, and the socket member and prong-members 180 of clip member 122 together form a connector permitting connection thereto of a coaxial transmission line. Socket opening 194 is further illustrated in the enlarged view of FIG. 2 which permits insertion therein of a coaxial conductor pin of the coaxial transmission line, or alternately, of an antenna pin of an antenna.

As noted briefly hereinabove, the spacing between the coaxial conductor pin and coaxial tube of a coaxial transmission line is, at least in part, determinative of the characteristic impedance of such line. For reasons of efficiency, a connector coupled to such a transmission line must be of a similar impedance. Accordingly, the distance separating socket member 114 and projecting prong-members 180 of assembly 100 of the present invention is also significant. The connector formed of such assembly is also of a characteristic impedance, Z, which can be characterized by the following equation:

$$Z=\ln (b/a)/\{v_o\epsilon_o(\epsilon_r)^{0.5}\Theta(1.41834-0.20916\Theta/\pi\}$$

where:

$v_o$ is the speed of light;

$\epsilon_o$ is the dielectric constant of free space;

$\epsilon_r$ is the relative dielectric constant of the dielectric filling of the transmission line;

$\Theta$ is the length of an arc formed by an outer conductor, here the projecting prong-members;

a is the diameter of socket 114; and b is the diameter across opposing sides of the outer conductor comprised of the projecting prong-members.

As noted hereinabove, existing testing apparatus is typically of a fifty ohm impedance; appropriate selection of the lengths of diameters a and b can produce a connector of a corresponding fifty ohm impedance.

The enlarged view of FIG. 2 further shows the portions of fin members 188 and 192 which extend through alignment ports 148-2 and 148-1, respectively. It is again noted that conductive portion 128 formed upon a face surface of circuit board 106 extends to segmental-slots 140-1 and 140-2, but does not extend to the first receiving port through which socket 114 extends.

The enlarged view of FIG. 2 further illustrates angled pieces 196 and 198 formed of portions of fin members 188 and 192, respectively. Angled pieces 196 and 198 are portions of fin members 188 and 192, respectively, which are defined by the longitudinal cuts made to the fin members and which become angled upon application of bending forces to such portions of the fin members. Such portions are angled outwardly from the planar face formed of such fin members once the fin members are inserted to extend through the respective alignment ports 148-1 and 148-2. The angled members are operative to retain clip member 122 in position once the clip member is positioned as shown in the figure.

Embossed buttons are also shown upon prong-members 180 in the enlarged view of FIG. 2. Such embossed buttons are operative to assist in the electrical connection between the prong fingers 180 and a coaxial tube of a coaxial transmission line when coupled thereto.

Figure 3:
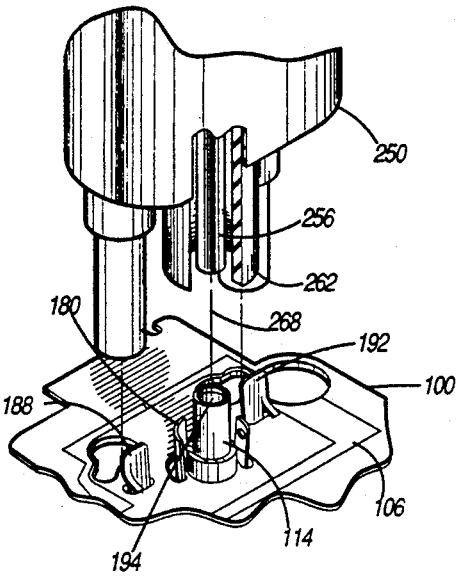
FIG. 3 is an exploded view of the assembly of the preferred embodiment of the present invention positioned to receive a coaxial transmission line.

Turning next to the exploded view of FIG. 3, assembly 100 is positioned to receive coaxial transmission line 250. As shown, coaxial transmission line 250 is comprised coaxial conductor pin 256 and coaxial tube 262 positioned about the conductor pin 256 at a distance spaced apart therefrom. As illustrated in the figure, coaxial transmission line 250 is positioned above assembly 100 and is aligned therewith.

Once aligned such that conductor pin 256 is in-line with socket opening 192 of socket member 114 and coaxial tube 262 is aligned with prong-members 180, transmission line 250 is lowered in the direction indicated by arrow 268 such that socket member 114 receives the conductor pin 256 therein and face surfaces of prong members 180 of the clip member engage with sidewall surfaces of coaxial tube 262. Coaxial transmission line 250 is thereby connected to assembly 100 by simple, relative, vertical translation between line 250 and assembly 100.

Figure 4:
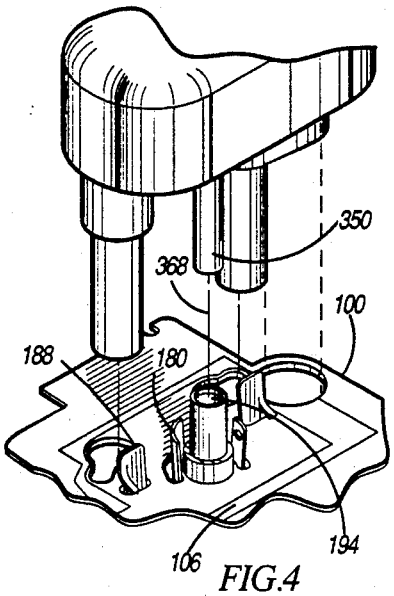
FIG. 4 is a view, similar to that of FIG. 3, but illustrating the assembly positioned to receive an antenna pin of an antenna.

FIG. 4 is an exploded, cut-away view, similar to that of FIG. 3, but illustrating an assembly including an antenna pin, here referred to by reference numeral 350, positioned above assembly 100. Antenna pin 350 is a rigid, pin member which forms an electrical cable coupled to an antenna (not shown). By positioning the antenna pin 350 above assembly 100, aligning the antenna pin 350 with socket opening 192 of socket member 114, and lowering the antenna pin into socket member 114 in the direction indicated by arrow 368, socket member 114 and antenna connector pin 350 become electrically connected theretogether.

As will be noted hereinbelow, in the preferred embodiment of the present invention, socket member 114 is operative primarily as an electromechanical connection to support to connector pin 350, as the antenna connector pin 350 is of a length permitting insertion into socket member 114. Socket member 114 may separately be connected to an electrical circuit. In such embodiment, socket member 114 is operative to provide the electrical connection between the antenna connector pin and the electrical circuit. (In an alternate embodiment, the pin may be of a length to protrude beyond an opposing side thereof. The antenna connector pin 350 may then be directly coupled to an electrical circuit.)

Figure 5:
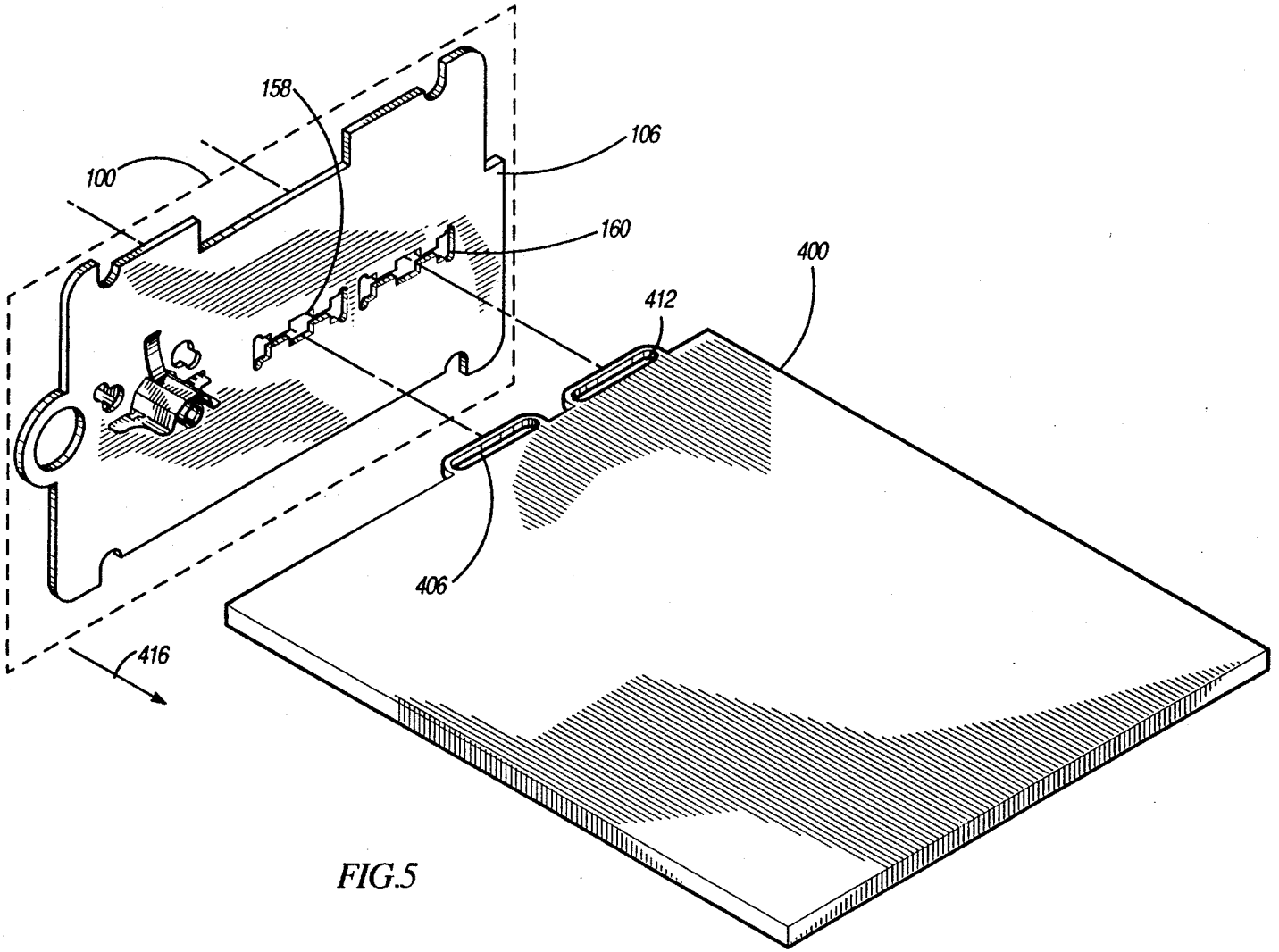
FIG. 5 is a perspective view of the assembly of the preceding figures in which the socket member and clip member are affixed to an antenna circuit board and the antenna circuit board is positioned proximate to a receiver circuit board.

Turning now to the perspective view of FIG. 5, antenna circuit board 106, which forms a portion of assembly 100 of the preferred embodiment of the present invention, is positioned in abutting engagement with receiver circuit board 400. As noted hereinabove, in many conventional radio receiver and radio transceiver constructions, both an antenna circuit board such as circuit board 106 and a primary, receiver circuit board, such as circuit board 400, are utilized. Substantial portions of the electronic circuitry comprising the receiver circuitry is disposed upon the receiver circuit board, and the antenna circuit board is positioned such that a face surface thereof abuts against a side, edge surface of the receiver circuit board. The antenna circuit board is operative to facilitate connection of an antenna to the receiver circuitry disposed upon the receiver circuit board.

It should be understood that the assembly of the preferred embodiments of the present invention may be utilized in any apparatus in which an electrical cable or coaxial transmission line is to be connected to electrical circuitry. While, by way of example, circuit board 400 is referred to as a receiver circuit board having receiver circuitry disposed thereupon, circuit board 400 could, of course, similarly have transmitter or both transmitter and receiver circuitry disposed thereupon. Accordingly, circuit board 400 could alternately be referred to as a transmitter circuit board.

Assembly 100, as noted in the preceding figures, is comprised of a portion of antenna circuit board 106, socket member 114, and clip member 122; such assembly 100 is represented in the figure by the elements pictured within the rectangle drawn in hatch.

As illustrated in FIG. 5, therefore, antenna circuit board 106 is positioned beyond an edge surface of receiver circuit board 400. Positioned to protrude beyond the edge side surface of receiver circuit board 400 are U-shaped fasteners 406 and 412 which are positioned to permit insertion through longitudinally-extending slots 158 and 160 of antenna circuit board 106. Semi-circular body portion 176 of clip member 122 protrudes beyond the face surface shown in the figure of circuit board 106. Fin members 188 and 192 of clip member 122, projecting prong-members 180 of clip member 122, and socket member 114 protrude beyond a face surface of antenna circuit board 106 hidden from view in the figure.

When antenna circuit board 106 and receiver circuit board 400 are properly aligned, antenna circuit board 106 may be translated in the direction indicated by arrow 416 (or, conversely, the receiver circuit board may be translated in the direction opposite to that of arrow 416) to position slotted protrusions 406 and 412 through slots 158 and 160, respectively. In the preferred embodiment of the present invention, circuit board clip 172 shown in FIG. 1 is utilized to fasten antenna circuit board 106 and receiver circuit board 400 theretogether. The receiving and alignment ports 134, 140-1, 140-2, 148-1 and 148-2 (not separately numbered in the perspective view of FIG. 5) are formed to extend through an antenna circuit board 106 at locations such that when socket member 114 and portions of clip member 122 are positioned to extend through respective ones of the ports, the planar surface formed of the face surfaces of fin members 188 and 192 of the clip member seat against a face surface of receiver circuit board 400.

Such surfaces may be electrically connected to a circuit disposed upon circuit board 400. As fin members 188 and 192 of clip member 122 are integrally formed with projecting prong-members 180 of the clip member (which extend beyond the face surface of antenna circuit board 106 hidden from view in the figure), a coaxial tube of a coaxial transmission line, when coupled to the prong-members, is also electrically connected to the fin members, and hence, to an electrical circuit to which the fin members may be connected.

Additionally, socket member 114 is positioned at a location such that an antenna pin, such as antenna pin 350 of FIG. 4, or a coaxial conductor pin, such as coaxial conductor pin, such as coaxial conductor pin 256 of FIG. 3 may project therethrough, also to seat against a face surface of receiver circuit board 400. Such antenna pin or coaxial conductor pin may similarly be electrically connected to an electrical circuit disposed upon circuit board 400 either directly, or by way of the socket member.

Assembly 100 is advantageously utilized to form an electrical connector to electrically connect an electrical cable, or alternately, a coaxial transmission line to an electrical circuit, such as a circuit disposed upon circuit board 400, as the connector formed of such assembly may be quickly and inexpensively constructed by an assembly line-like technique. Either an antenna used during normal operation of the radio receiver or test equipment having a coaxial cable may be connected thereat.

Figure 6:
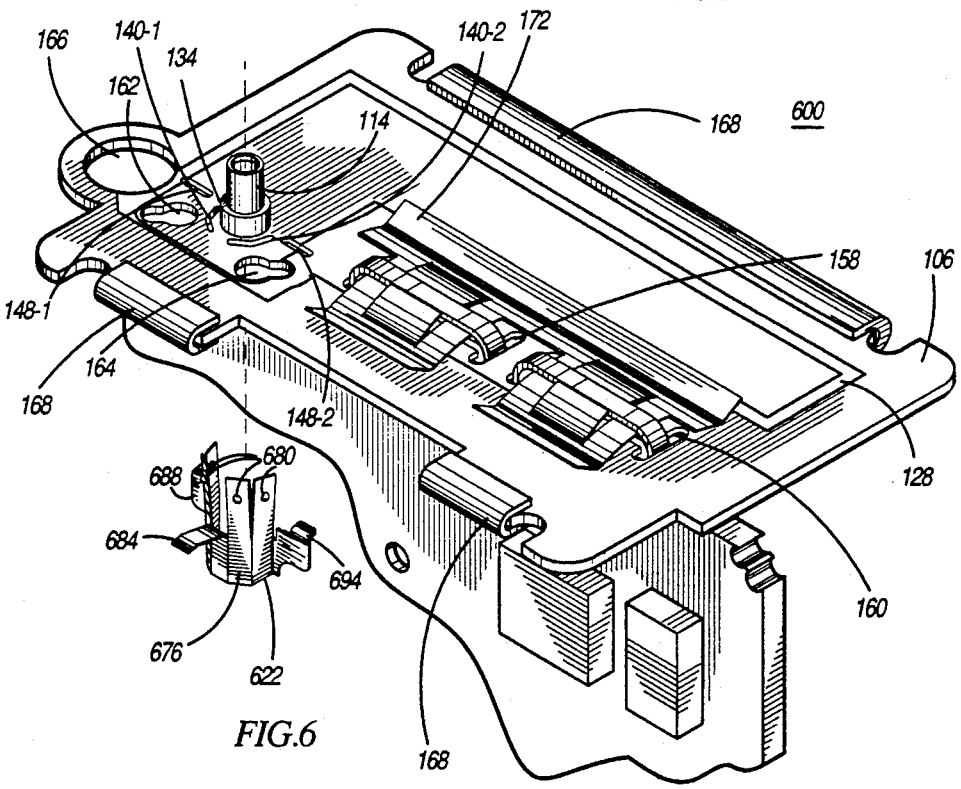
FIG. 6 is an exploded view, similar to that of FIG. 1, but illustrating an assembly of an alternate, preferred embodiment of the present invention.

Turning next to the exploded view of FIG. 6, an assembly, here referred to generally by reference numeral 600, of an alternate embodiment of the present invention is shown. The view of FIG. 6 is similar with that of the exploded view of FIG. 1, and only differs in the construction of the clip member, here referred to by reference numeral 622, and in the addition of alignment port 148-3 extending through circuit board 106. The other portions of assembly 600 are identical to those previously disclosed in FIG. 1, and such identical portions are again referred to by the same reference numerals used previously. Because such portions have been previously described, the portions of assembly 600 identical to those portions previously described will not be described in detail again.

Clip member 622 is similar to that of clip member 122 of FIG. 1 and includes a semi-circular body portion, here designated by reference numeral 676, and projecting prong-members, here designated by reference numeral 680, projecting beyond body portion 676. Formed to extend beyond opposing end side surfaces of body portion 676 are fin members, here designated by reference numerals 688 and 694. Fin members 688 and 694 include angled, end portions which, once inserted through corresponding ones of alignment ports 148-1 and 148-2 of antenna circuit board 106 seat against a face surface thereof.

Clip member 622 further includes an angled shankpiece 684 which, similar to angled shankpiece 184 of clip 122, extends at an angle substantially perpendicular to the body portion 676. Angled shankpiece 684 is bent to form an engaging clip which, upon application of a compressive force, bends to permit insertion of a portion of the engaging clip into alignment port 148-3 extending through antenna circuit board 106. The compressive force exerted upon such portion of shankpiece 684 affixes the clip member 622 in position at the circuit board 106. Clip member 622, once affixed to circuit board 106 is operative in a manner similar to that of clip member 122 shown in the preceding figures. In this embodiment, fin members 688 and 692 are first inserted into alignment ports 148-1 and 148-2, respectively, and the angled, end portions of the fin members are positioned to seat against a face surface of circuit board 106. Then, the compressive force is exerted upon angled shankpiece 684, and the portion of the angled shankpiece which forms the engaging clip is inserted through alignment port 148-3. Once inserted therethrough, and the compressive force is no longer applied to the angled shankpiece, the shankpiece returns to an unstressed position in which the clip member becomes affixed to the circuit board.

Figure 7:
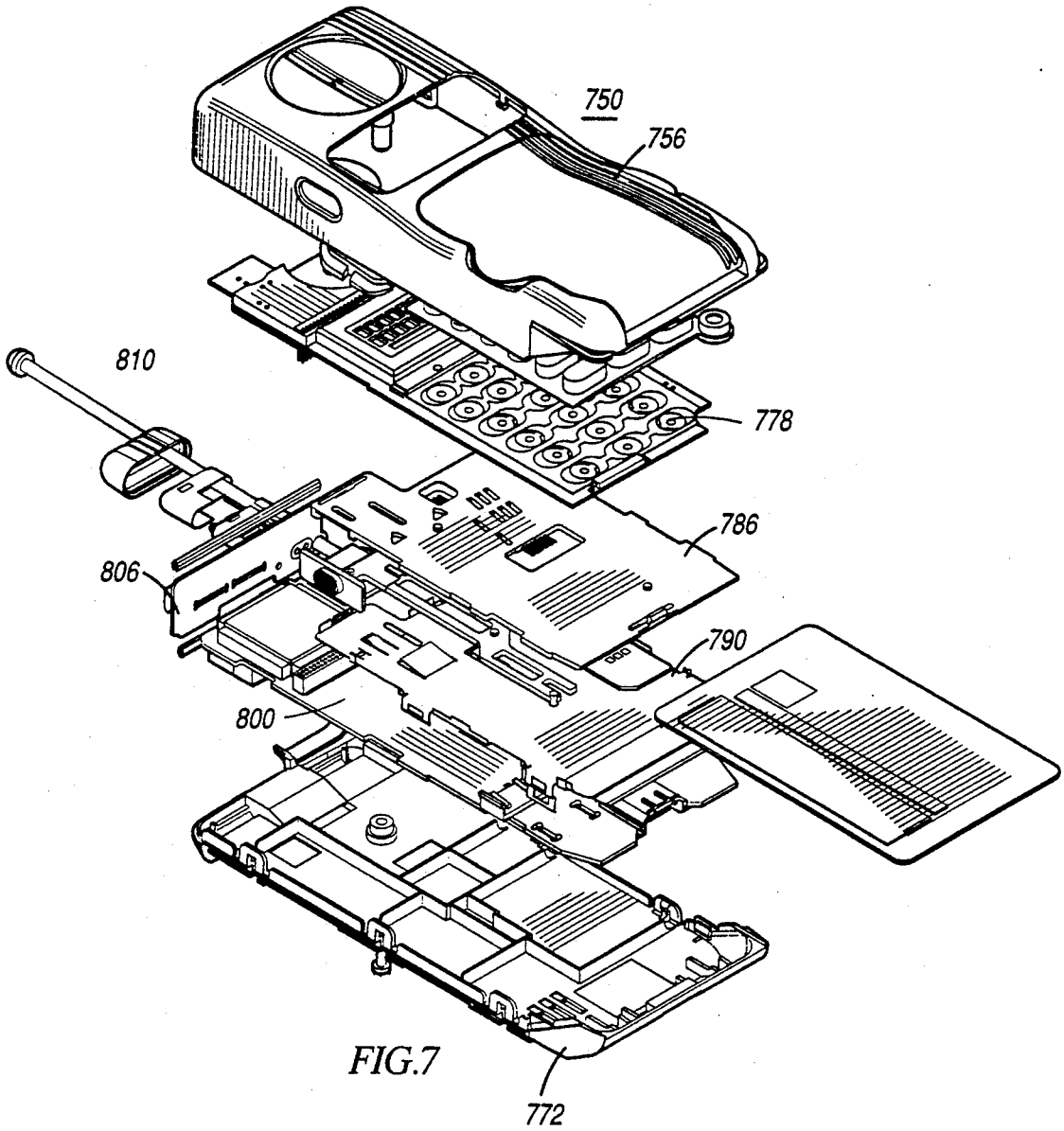
FIG. 7 is an exploded view of a radio transceiver of a preferred embodiment of the present invention of which the assembly of one of the preferred embodiments of the preceding figures forms portion.

FIG. 7 is an exploded view of a radio transceiver, here a portable, cellular radiotelephone, referred to generally by reference numeral 750. Radiotelephone 750 includes, as a portion thereof, an assembly corresponding to assemblies 600 or 100 of the preceding figures. Radiotelephone 750 includes a supportive housing structure for supporting various components of the radio telephone therewithin. Top housing portion 756 of the housing structure include sidewall flanges extending about portions of an outer parameter of a top face surface of the housing structure. Rear housing 772 also forms a portion of the housing assembly and also includes flange portions formed about perimetal portions thereof which form sidewalls which matingly engage with corresponding sidewalls 762 extending about top housing portion 756.

Positioned directly beneath front housing 756 is key pad circuit board 778. Component portions of a card reader assembly for receiving card 582 are positioned beneath key pad circuit board 778.

The card reader assembly is shown to be comprised of slider plate 786 and cover plate 790.

Receiver circuit board 800 (which corresponds to receiver circuit 400 of the preceding figures) is positioned beneath cover plate 790 of the card reader assembly. Antenna circuit board 806 (which corresponds to antenna circuit board 106 of the preceding figures) is positioned at an end side surface of receiver circuit board 800. While partially hidden from view in the exploded view of FIG. 7, antenna circuit board 806 includes first and second receiving ports, and alignment ports similar to those shown in the preceding figures, and also a socket member and a clip member, again substantially similar to those shown in the preceding figures.

An antenna, here indicated by reference numeral 810, is also shown to project beyond antenna circuit board 806. Antenna 810 includes an antenna pin which is connected to the assembly formed of a clip member, socket member, and portion of the antenna circuit board, as described in detail above. The antenna 810 may be removed from its connection with the connector formed of the assembly shown in the preceding figures by merely applying a separation force to the antenna.

Figure 8:
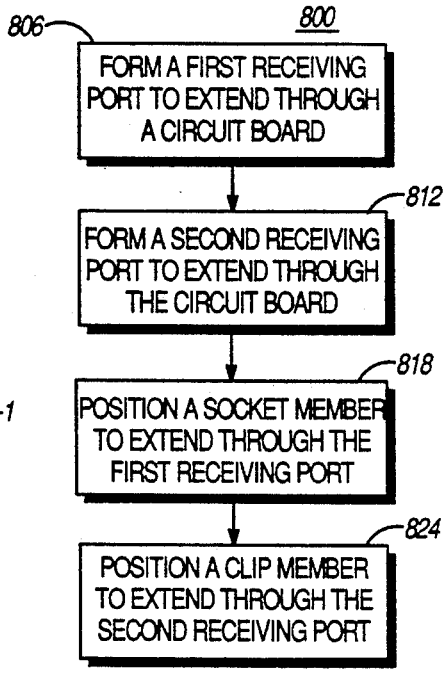
FIG. 8 is a logical flow diagram of the method of a preferred embodiment of the present invention.

Turning finally now to the logical flow diagram of FIG. 8, the method steps of the method, referred to generally by reference numeral 800 of the preferred embodiment of the present invention for connecting an electrical circuit to an electrical cable, or alternately, to a coaxial transmission line, is disclosed.

First, and as indicated by block 806, a first receiving port is formed to extend through the circuit board. Next, and as indicated in block 812, a second receiving port is formed to extend through the circuit board at a location spaced-apart from the first receiving port and proximate to a conductive line forming a portion of the electrical circuit.

Next, and as indicated in block 818, a socket member is positioned to extend through the first receiving port to be supported thereat. The socket member is comprised of an electrically-conductive material and is operative to receive the electrical cable, or alternately, a coaxial conductor pin of the coaxial transmission line therein, thereby to permit electrical connection of the electrical cable, or, alternately, of the coaxial conductor pin therewith, and, hence, also with the electrical circuit.

Finally, and as indicated in block 824, a clip member is positioned to extend through the second receiving port to be supported thereat. The clip member is comprised of an electrically-conductive material and engages with a coaxial tube which surrounds the coaxial conductor pin of a coaxial transmission line, thereby to connect electrically the coaxial tube of the coaxial transmission line with the conductive line leading to the second receiving port.

Because the assembly is formed by a single-direction process in which the socket member and clip member are inserted into receiving ports formed to extend through the circuit board, the assembly can be assembled simply, and at high volume. The assembly of the present invention, accordingly, may be advantageously utilized to form portions of devices which are constructed by assembly line-like operations. The socket member and clip member may further be constructed independently, and may be affixed to the circuit board by a reflow solder technique.

While the present invention has been described in connection with the preferred embodiments shown in the various figures, it is to be understood that other similar embodiments may be used and modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. An electrical connector assembly comprising:

an electrical circuit having at least one circuit path;

a substrate having a first receiving port formed to extend through the substrate, and a second receiving port, spaced-apart from the first receiving port and also formed to extend through the substrate;

an electrically-conductive socket member positioned to extend through the first receiving port of the substrate to be supported thereat such that, when positioned to extend therethrough, the socket member abuts against a circuit path of the at least one circuit path of the electrical circuit;

an electrically-conductive clip member comprised of a semi-circular body portion and at least one projecting prong member formed to extend beyond the semi-circular body portion wherein the at least one projecting prong is positioned to extend through the second receiving port to be supported thereat, the at least one projecting prong-member having an end portion thereof forming a spring finger; and an electrical cable and a coaxial transmission line having a coaxial conductor pin and a coaxial tube positioned thereabout, the electrical cable and the coaxial transmission line being alternately connectable to the electrical circuit when an end of the electrical cable is inserted into the socket member or, alternately, the coaxial conductor pin is inserted into the socket member and the coaxial tube clippingly engages with the spring finger formed at the end portion of the at least one projecting prong of the clip member.

2. The assembly of claim 1 wherein said substrate comprises a circuit board.

3. The assembly of claim 1 wherein the first receiving port comprises a substantially circular aperture formed to extend through the substrate.

4. The assembly of claim 1 wherein said socket member is generally tubular in configuration and comprises a lipped portion extending about a circumferential portion thereof, said lipped portion having seating surface for seating against a face surface of the substrate, thereby to be supported at the first receiving port when the seating surface of the lipped portion seats against the face surface of the substrate.

5. The assembly of claim 1 wherein a circuit path of the at least one circuit path of the electrical circuit comprises a a conductive line disposed upon a face surface of the substrate, wherein the conductive line extends to the second receiving port.

6. The assembly of claim 5 wherein the conductive line leading to the second receiving port comprises a ground plane of the electrical circuit.

7. The assembly of claim 1 wherein said second receiving port comprises at least one segmental slot formed to extend through the substrate.

8. The assembly of claim 7 wherein said second receiving port comprises a first, angled segmental slot spaced-apart from the first receiving port beyond a first side portion of the first receiving port, and a second, angled segmental slot spaced-apart from the first receiving port beyond a second side portion of the first receiving port, the first and second, angled segmental slots, respectively, together forming the second receiving port of a generally semi-circular configuration of a circle centered at the first receiving port.

9. The assembly of claim 9 wherein said clip member comprises a semi-circular body portion and at least two projecting prong-members wherein a first of the at least two projecting prong-members extends through the first angled segmental-slot and a second of the at least two projecting prong-members extends through the second, angled segmental-slot, each of the at least two projecting prong-members having an end forming a spring finger for clippingly engaging with the coaxial tube of the coaxial transmission line.

10. The assembly of claim 9 wherein the at least two projecting prong-members comprises a plurality of projecting prong-members extending beyond the semi-circular body portion, the plurality of projecting prong-members together having a semi-circular cross-section.

11. The assembly of claim 9 wherein the clip member and the socket member are spaced-apart by distances such that the clip member and the socket member together form a coaxial connector of a desired characteristic impedance.

12. The assembly of claim 9 further comprising at least one alignment port formed to extend through the substrate.

13. The assembly of claim 9 wherein said clip member further comprises an angled-shankpiece extending at an angle substantially perpendicular to the semi-circular body portion, the angled-shankpiece for forming a seating surface for seating against a face surface of the substrate, thereby to support the clip member at the second receiving port.

14. The assembly of claim 13 wherein the angled-shankpiece extends at the angle substantially perpendicular to the semi-circular body portion at a location beneath the projecting prongs whereby seating of the seating surface of the angled-shankpiece against the face surface of the substrate positions the projecting prongs to extend beyond the face surface of the substrate.

15. The assembly of claim 12 wherein said clip member further comprises at least one fin member extending beyond an end side portion of the semi-circular body portion, the fin member being elongated in a longitudinal direction to extend through the at least one alignment port formed through the substrate.

16. The assembly of claim 15 wherein the at least one alignment port comprises a first alignment port and a second alignment port, the first alignment port positioned beyond the first, angled segmental-slot and the second alignment port positioned beyond the second, angled-segmental slot.

17. The assembly of claim 15 wherein the at least one fin member further comprises means for retaining the fin member and the clip member coupled thereto in position once positioned to extend through the at least one alignment port.

18. The assembly of claim 17 wherein the at least one fin member comprises a first fin member extending beyond a first end side of the semi-circular body portion for extension through the first alignment port, and a second fin member extending beyond a second end side of the semi-circular body portion for extension through the second alignment port.

19. An electrical connector assembly comprising:

an electrical circuit having at least one circuit path;

a substrate having a circuit path of the at least one circuit path of the electrical circuit disposed thereupon, a first receiving port formed to extend through the substrate, and a second receiving port, spaced-apart from the first receiving port and also formed to extend through the substrate, the circuit path of the electrical circuit disposed upon the substrate having a conductive line leading to the first receiving port;

an electrically-conductive socket member positioned to extend through the first receiving port of the substrate thereat, such that, when positioned to extend therethrough, the socket member abuts against the circuit path disposed upon the face surface of the substrate;

an electrically-conductive clip member comprised of a semi-circular body portion and at least one projecting prong member formed to extend beyond the semi-circular body portion wherein the at least one projecting prong is positioned to extend through the second receiving port to be supported thereat, the at least one projecting prong-member having an end portion thereof forming a spring finger; and an electrical cable and a coaxial transmission line having a coaxial conductor pin and a coaxial tube positioned thereabout, the electrical cable and the coaxial transmission line being alternately connectable to the electrical circuit when an end of the electrical cable is inserted into the socket member or, alternately, the coaxial conductor pin is inserted into the socket member and the coaxial tube clippingly engages with the spring finger formed at the end portion of the at least one projecting prong of the clip member.

* * * * *